US005788294A

United States Patent [19]

Leon et al.

[11] Patent Number: 5,788,294

[45] Date of Patent: Aug. 4, 1998

[54] TAMPER DETERRING SEAL

[75] Inventors: Jeremy Phelps Leon, Morris Township; George Albert Lundberg, Jr., Pompton Plains, both of N.J.

[73] Assignee: E. J. Brooks Company, Newark, N.J.

[21] Appl. No.: 794,947

[22] Filed: Feb. 4, 1997

[51] Int. Cl.[6] ..... B65D 27/30

[52] U.S. Cl. ..... 292/307 R; 292/315; 292/321; 292/325

[58] Field of Search ..... 292/307 R, 315, 292/319, 321, 325, 326, 307 B, 318, 317; 24/16, 17, 30.5 R, 30.5 P

[56] References Cited

U.S. PATENT DOCUMENTS

| | | | |
|---|---|---|---|
| 1,863,041 | 6/1932 | Dessauer | 292/307 R |
| 1,952,085 | 7/1934 | Mayer | 292/307 R |
| 1,977,301 | 10/1934 | Bradford | 292/307 R |
| 2,899,230 | 8/1959 | Moberg | 292/325 |
| 5,114,196 | 5/1992 | Storer | 292/307 R |

*Primary Examiner*—Brian K. Green
*Assistant Examiner*—Fredrick Conley
*Attorney, Agent, or Firm*—William Squire

[57] ABSTRACT

Integral one piece molded thermoplastic male and female housing segments are interconnected by a bridge member via living hinges. The female segment has a sheet metal insert with a locking aperture. A wire or other member is inserted in passages in the two segments in an unfolded position forming a loop whose ends are passed through the passages. An edge of the insert is adjacent to the passages in the female segment. The male housing segment has a locking stud extending therefrom and engaged with the insert locking aperture locking the male segment in a recess in the female housing segment. The bridge member encloses a housing end and the passages at that end. The folded over segments cause the wire to bend sharply in a 180° bend about the insert edge. The edge digs into the wire upon withdrawal of the wire from the passages, severing the wire. Different embodiments are disclosed.

23 Claims, 3 Drawing Sheets

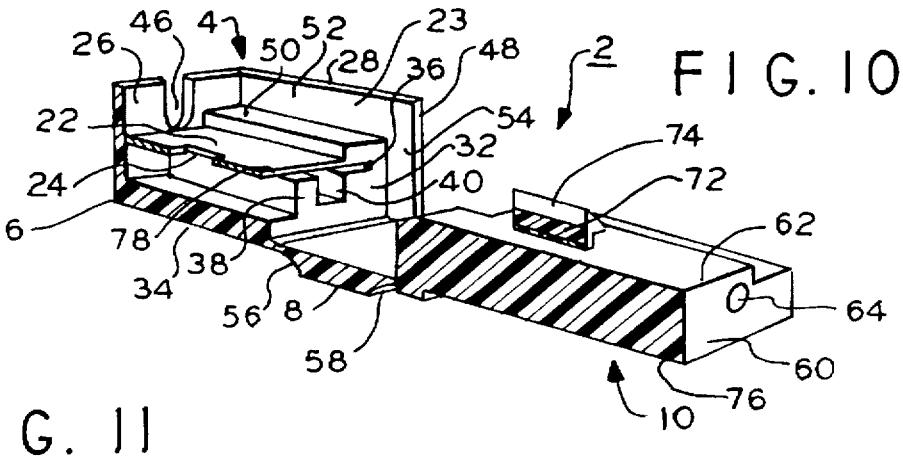
FIG. 10
FIG. 11
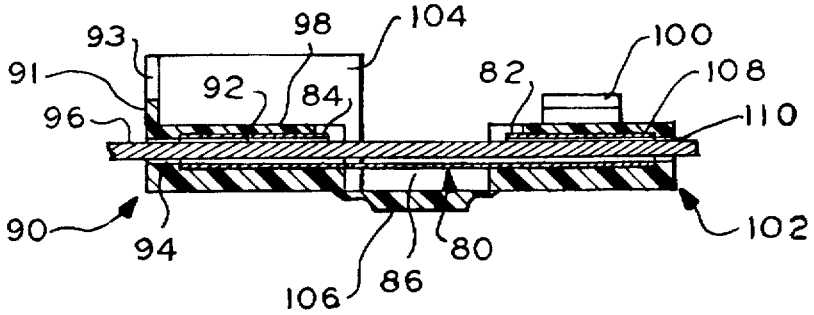
FIG. 12
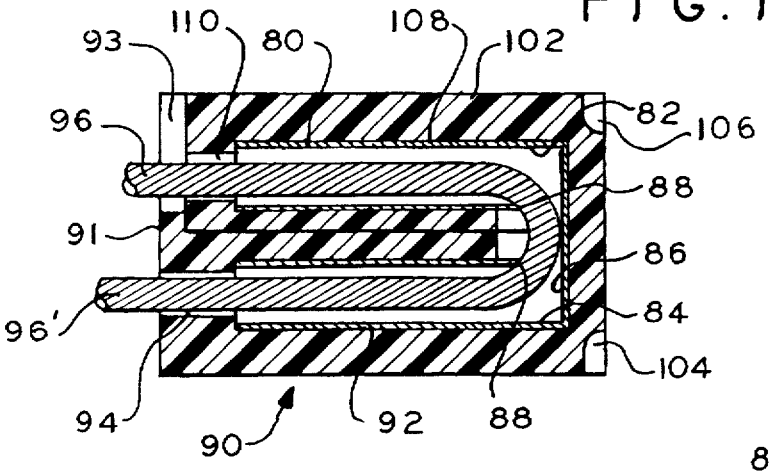
FIG. 13
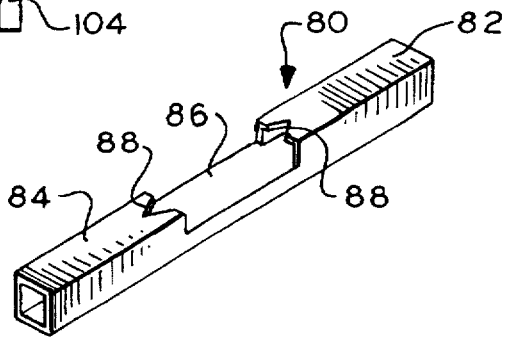

TAMPER DETERRING SEAL

This invention relates to seals, and more particularly, to seals which secure a strap or wire thereto for indicating tampering with a lock.

Seals are widely used to indicate tampering with locked enclosures, for example, cabinet doors, electric utility meters, vehicle doors and so on. Specific seal designs are provided according to a given implementation. Some seals are molded thermoplastic with locking spring fingers in a lock body cavity for engaging locking shoulders on mating locking studs or straps. The straps or wires used in conjunction with such seals are wrapped about a hasp or the like and then locked to the seal.

Typically such seals are intended to be destroyed if the lock and doors are opened to show tampering. Often, thieves are able to circumvent such seals without showing tampering. There thus always exists a need for further improved seals to counter such tampering. One type of seal in use employs relatively small diameter flexible stranded wires for sealing utility meters. Such wire seals typically employ tools to lock the seals because of the relatively high forces imposed by wires during the seal locking action. See for example commonly owned U.S. Pat. No. 5,180,200. What is needed is a tamper evident seal which has a wide range of applications and is useful with steel wire without tools.

U.S. Pat. No. 4,883,295 discloses an all plastic tamper deterrent assembly comprising molded plastic including a body member with an enclosed locking space having an open end. The open end is closed by a closure member mounted on the body member and movable toward a closed end of the locking space. The closure member is retained on the body member in a first position and is moved to a locking position where a strip engaging unit carried by the closure member is received and locked by a locking unit. The strip is relatively wide and is thermoplastic. This structure therefore is not useful for sealing relatively small apertures as occurs in electric utility meters. Also, a wire if used in place of a strip would tend to damage the internal plastic material during tamper withdrawal. The wire could then be replaced without tampering being evident.

U.S. Pat. No. 3,107,935 discloses an injection molded seal device comprising a thermoplastic receptacle and plug assembly, the receptacle having a cavity with integrally formed internal flanges providing catch edges for a plug member. The flanges may be formed of a two part die. The flanges are flexible to permit the plug member to be inserted into the receptacle. The plastic plug has serrated edges to clamp a sealing ribbon to a bottom wall, the sealing ribbon being inserted before the parts are locked together. Multiple bends in a tortuous passageway are locked together. Multiple bends in a tortuous passageway provide gripping action of different ribbons which may have different dimensions. Each bend in the ribbon produces frictional engagement with the seal device, especially along the serrated edges.

However, this device contemplates multiple bends to enhance the gripping action of different thickness of ribbons. This device may not always provide tamper evidence if the ribbons are removable therefrom. Also, the ribbons are juxtaposed one over the other so that the serrated edges only contact one of the ribbons, such that the other ribbon may not be as securely gripped. Further, it is not clear from this patent that tamper evidence would necessarily be produced if the ribbon were attempted to be withdrawn. Further, the ribbon also will not mate with relatively small apertures as discussed above. Wires or other similar structures are not disclosed as operative with the disclosed device and would tend to damage the plastic parts thereof also as discussed above.

U.S. Pat. No. 5,114,196 discloses a tamper deterrent locking device. A flexible cable is secured to a female member, the cable forming a loop projecting from the female member. The cable free end projects through an aperture in the female member. A male member fits into the aperture to frictionally lock the cable between the male and female members. The loop is passed through two aligned holes in two pieces of relatively movable apparatus whereby the cable needs to be severed or disengaged from the frictional engagement. The all plastic construction may be easily defeated by damage in case a metal wire is used not contemplated by the disclosure thereof. Further, a bead 20 is needed on the end of the cable. More importantly, a ridge on the male member is retained by a shoulder on the female member, with the ridge and shoulder being easily accessible for tampering via an opening in the female member.

A seal according to the present invention comprises a female housing segment having front end and rear ends, the segment having a recess and a first passage leg in communication with the ambient at the front end and extending toward the rear end. A metal element is secured to the housing segment and has an edge distal the front end in communication with the first passage leg.

A male housing segment engages the female segment in the recess, the male segment forming a second passage leg at least when engaged, the second leg being in communication with the element edge and with the ambient at the female segment front end, the passage legs forming a U-shaped passage for receiving an elongated member, the U-shaped passage having a bend about the edge, the bend being sufficiently sharp such that the edge severs the received member in response to withdrawal of the received member from the passage in a direction along the passage, the male and female housing segments including complementary locking means for locking the male segment to the female segment in the recess and for locking the received member against the edge.

A seal for displaying tamper evidence according to a further aspect of the present invention comprises a housing. At least one U-shaped passage in the housing is in communication with the ambient external the housing through a housing wall, the passage for receiving an elongated member, the passage having spaced leg portions each adjacent to a different opening and a U-shaped bend portion located within the housing distal the wall.

An element is included having an edge, the edge being in communication with the bend portion of the at least one passage for engaging the received elongated member and for locking the elongated member to the housing, the bend portion being sufficiently sharp so that the edge severs the elongated member in response to withdrawal of the elongated member from the passage in a direction along the passage.

In one aspect, the housing includes a plurality of segments rotatable relative to each other, the segments each forming a leg portion for each of a plurality of passages and having a first position in which the leg portions of respective first and second passages are aligned for receiving the elongated member and a second interlocked position.

In a further aspect, the segments include a first segment having a first leg portion of each of the passages, a second segment having a second leg portion of each of the passages and a bridge member intermediate and coupled to the first and second segments for forming the bend portions with the housing.

In a still further aspect, the first segment has a recess for receiving the second segment, the bridge member being hinged to the first and second segments, the first and second segments including complementary locking means for locking the segments in the second interlocked position.

In a further aspect, a pair of U-shaped passages are in parallel side-by-side relation, the passages for receiving a different portion of the elongated member for locking the elongated member ends to the element.

In a further aspect, the element is sheet metal and the elongated member is a wire and at least a portion of the passages are contiguous with the element.

BRIEF DESCRIPTION OF THE DRAWING

FIG. 10 is an isometric sectional view of the seal of FIG. 6 without a wire attached thereto;

FIG. 11 is a side sectional elevation view of a preliminary assembly stage of a seal according to a second embodiment of the present invention;

FIG. 12 is a side elevation sectional view of the assembled locked seal of the embodiment of FIG. 11; and FIG. 13 is an isometric view of a metal insert used in the embodiments of FIGS. 11 and 12.

In FIGS. 1–10, seal 2 includes a housing 4 comprising a female segment 6, a bridge member 8 and a male segment 10. The segments and bridge member are preferably one piece molded thermoplastic material. The seal 2 permanently secures thereto the end regions 14, 16 of an elongated flexible member 12, such as stranded wire, cloth strip, string, nylon or other synthetic material filaments or cord and the like. The member 12 central region forms a loop 18 which is attached to a hasp 20 (FIG. 1) or other device desired to be secured by seal 2 such as a cover on an electric utility meter.

In FIGS. 5, 6 and 10, the seal 2 also includes a sheet metal insert 22 secured to female housing segment 6 in housing segment cavity 23. The insert 22 is preferably rectangular and made of spring steel about 0.010 inches (0.254 mm) thick. A rectangular opening 24 is centrally positioned in the insert 22. The edges of the insert are preferably linear, but not other wise processed to generate a sharp edge, the edge for severing a wire being merely due to the insert thickness in a manner to be explained. The edge could be made sharp if desired. The insert 22 may be made of stamped sheet metal and as such may have sharp edges as fabricated.

Figure 6:
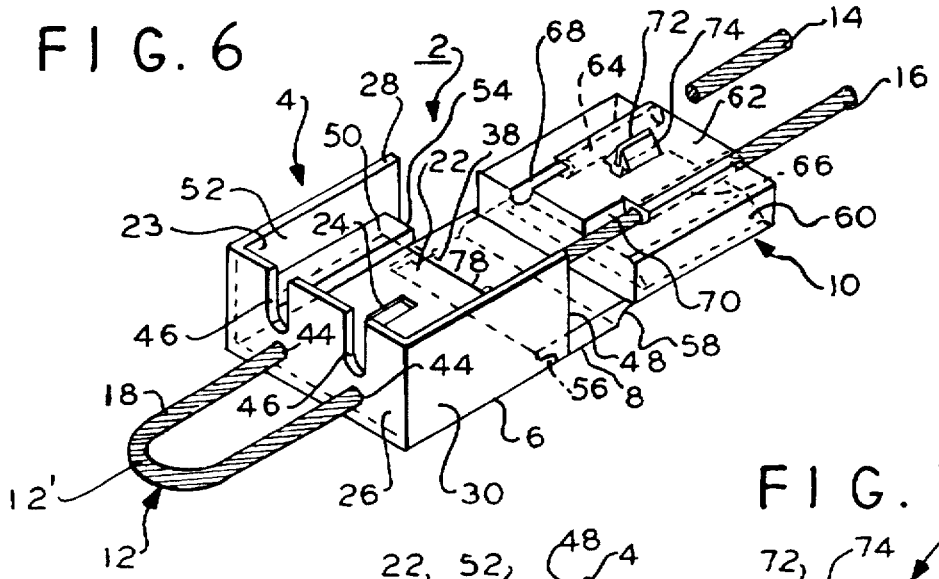
FIG. 6 is an isometric view of the seal of FIG. 1 taken at a preliminary assembly stage of the seal.

The segment 6, FIGS. 6 and 10, comprises a front wall 26 and side walls 28 and 30. A body member 32 is located in the cavity 23 and integral with the side walls and front wall and forms a bottom wall 34. Member 32, FIG. 10, has two slots 36 (one being shown in FIG. 10) on opposite sides of the cavity 23 adjacent the side walls 28 and 30. The slots 36 receive and secure the insert 22 in the cavity 23 parallel to the bottom wall 34.

Figure 9:
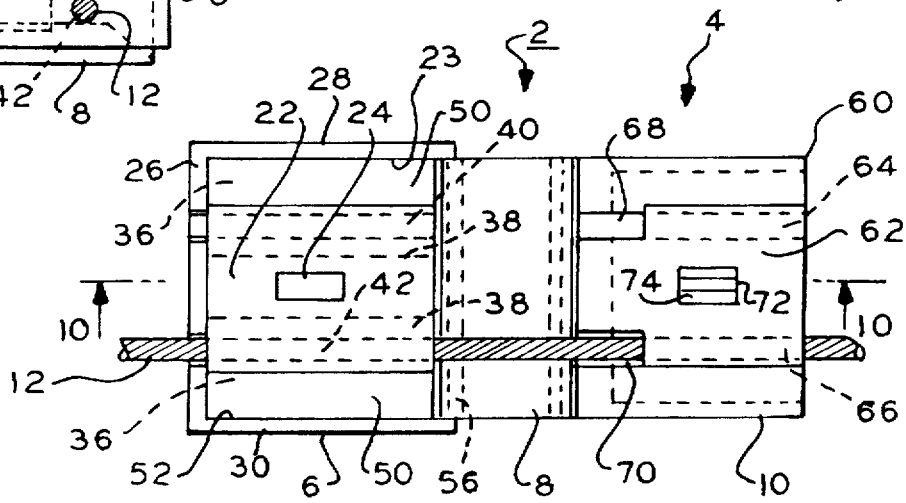

A pair of spaced mirror image ribs 38 (one being shown in FIG. 10 which is a mirror image of the housing segment 6 cut away) extend upwardly from bottom wall 34, FIGS. 9 and 10, forming with facing body member 32 portions linear parallel channel-like passage leg portions 40 and 42. The passage leg portions 40 and 42 are juxtaposed beneath and contiguous with the insert 22. The upwardly facing surfaces of ribs 38 provide a lower support for the insert 22.

Figure 1:
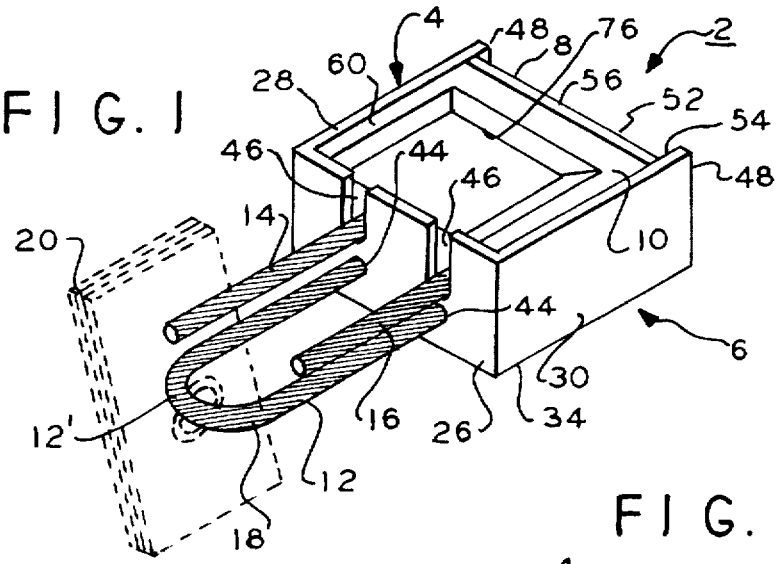
FIG. 1 is an isometric view of a seal according to the present invention for locking an elongated member such as a wire thereto.

A pair of apertures 44, FIG. 1, in the front wall 29 are respectively aligned with the passage leg portions 40 and 42. These apertures couple the passage portions 40 and 42 with the ambient external the housing front wall 26 and form a continuous passage therewith. A pair of slots 46 are in the front wall 26. The slots 46 are immediately above and correspond to a different aperture 44. The slots 46 communicate with a recess 52 in the housing 4 segment 6 cavity 23. The recess 52 is formed by top surfaces 50 of the body member 32 adjacent to each side wall 28 and 30 and by insert 22. Insert 22 and opening 24 in the insert 22 are thus exposed to the recess 52 at the insert top surface.

The body member 32 terminates inwardly from the vertical rear edges 48 of the side walls 28 and 30 forming a rearwardly facing recess 54 with the side walls 28, 30 and edges 48. The passage portions 40 and 42 terminate rearwardly in recess 54.

Figure 2:
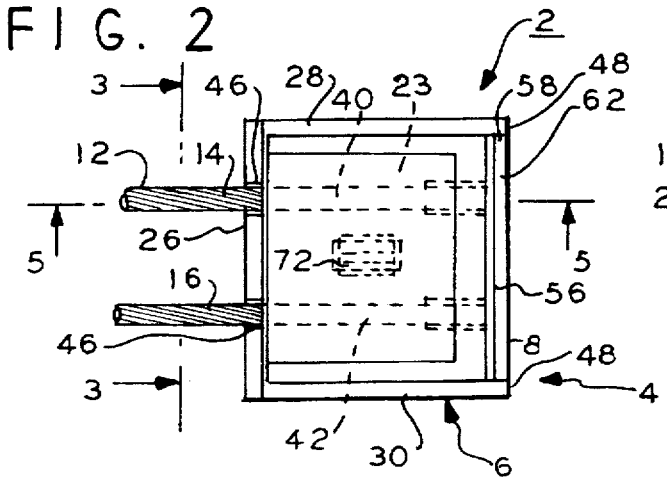
FIG. 2 is a top plan view of the seal of FIG. 1.

Bridge member 8 is connected to bottom wall 34 of segment 6 by a living hinge 56. Living hinges as known comprise a thinned section of molded thermoplastic material which is sufficiently thin to form a rotatable member without damage to the material. The hinge 54 extends across the width of the segment 6 as does the bridge member 8. The hinge 56 is reduced in section on both sides of the bridge member 8. The hinge 56 is attached to the bottom wall recessed in recess 54. When the member 8 is rotated it enters the recess 54 and is flush with the edges 48 of the segment 6 sidewalls 28 and 30, FIG. 2. The bridge member 8 is generally a sheet structure.

Figure 7:
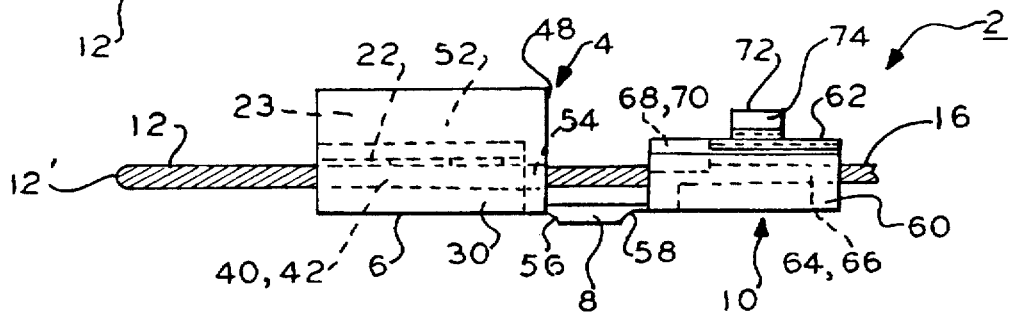
FIGS. 7, 8 and 9 are respective side, front and top plan views of the seal of FIG. 6.
Figure 8:
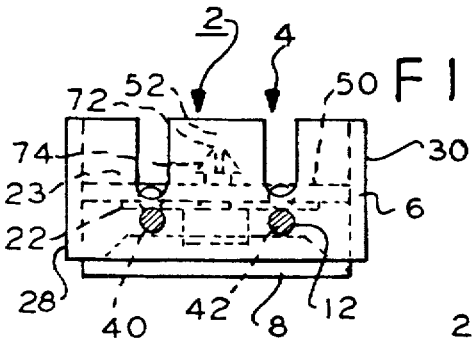

A second living hinge 58, FIGS. 6 and 7, connects the bridge member 8 to the housing male segment 10. In FIGS. 6, 7, 9 and 10, the segment 10 comprises a generally rectangular body 60. Body 60 is dimensioned to be closely received in recess 52. A mesa 62 extends upwardly from the body 60. A pair of mirror image passage leg portions 64 and 66 are formed in body 60 and mesa 62. An open channel 68 and 70 is formed in body 60 and mesa 62 as a continuation of the respective passage portions 64 and 66.

The male segment passage leg portion 64, 66, channels 68, 70 and female segment passage leg portions 40, 42 are respectively axially aligned as shown in FIGS. 6–9. In this position the housing segments 6 and 10 are unfolded in an extended state for receiving the elongated member 12, preferably a stranded steel wire for use as a utility meter seal. The body 60 has a recess 76, FIG. 1, on a side opposite mesa 62. The recess 76 is in communication with an end of the body 60 opposite the bridge member 8.

Figure 3:
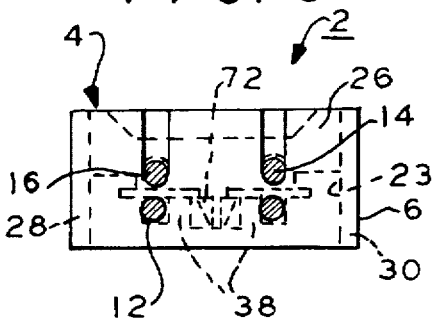
FIG. 3 is a front elevation sectional view of the seal of FIG. 2 taken along lines 3—3.
Figure 4:
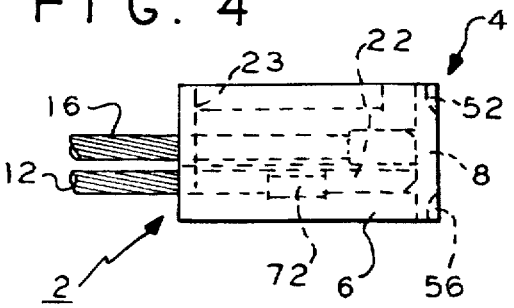
FIG. 4 is a side elevation fragmented view of the seal of FIG. 1.

A male locking stud 72, FIGS. 6–9, comprises a bifurcated arrow head 74 with locking shoulders spaced above mesa 62. The stud 72 shoulders resiliently engage, by inward compression, the opening 24 edges in the insert 22, FIGS. 2–4. The stud shoulders snap engage the insert 22 and lock the stud 72 to the metal insert 22. The male segment 10 body 60 and mesa 62 are thus locked in the female recess 52 in the folded locked position of the seal 2. Once so engaged, the locking stud can not be disengaged from the insert without destroying it. The metal insert provides additional tamper resistance by destroying the head 74 of the stud 72 if disengaged by tampering. This makes the seal 2 unusable and provides tampering evidence.

In operation, one end region 14 or 16 of a wire or other elongated member 12 is inserted in the aligned passage portions 42 and 66, FIGS. 6–9, of the unfolded housing 4. A second end region of the member 12 is inserted in the other aligned passage portions 40 and 64. A portion of the member 12 is in the channels 68 and 70 in the male segment 10. The elongated member 12 is juxtaposed over the bridge member 8. The member 12 forms a loop 12'. The member 12 end regions 14 and 16 protrude from the housing 4 male segment 10. The loop 12' is passed through an aperture in a hasp 20 (FIG. 1) or other structure to be secured.

Figure 5:
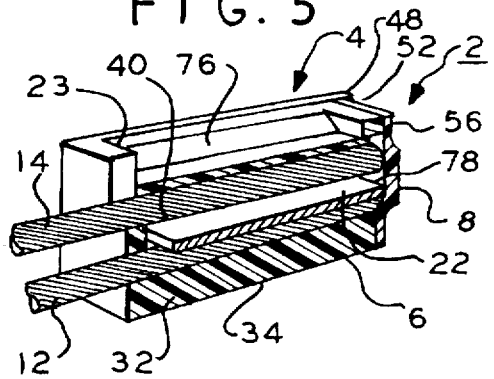
FIG. 5 is an isometric sectional view of the seal of FIG. 2 taken along lines 5—5.

The male segment 10 is then folded over at the hinges of the bridge member 8 and inserted into the female housing segment 6 recess 52. The bridge member 8 fits into the recess 54, FIGS. 1, 2, 4 and 5. This encloses the open rear end of the housing at recess 54, enclosing the ends of the passage portions 40, 64 and 42, 66. The slots 46 in the housing segment 6 front wall 26 accommodate the elongated member 12 end regions 14 and 16 as the male segment 10 is rotated during the attachment of the stud 72. The channels 68 and 70 in the male housing segment 10 accommodate the elongated member 12 as it bends over the edge 78 of the insert 22, FIG. 5. This folding over action creates a U-shaped bend portion at the edge 78 in the resulting passage. This thus forms a pair of U-shaped composite passages in side-by-side relation.

The U-shaped bend is preferably 180° and is relatively sharp. The sharpness of the bend is contributed to by the passage leg portions 40 and 42 being contiguous with the insert 22. Also, the passage walls of passage leg portions 64 and 66 in the female segment mesa 62 are relatively thin also contributing to the sharpness of the bend at the insert 22 edge 78.

The bend while preferably 180° may be in the range of about 160°–200° by way of example. This range is important only to the extent that the bend is sufficiently sharp to result in the severence of the elongated member in response to axial withdrawal pulling forces on the elongated member in a direction along the U-shaped passage longitudinal dimensions. The elongated member need not be forced against the edge by the bridge member. It is the relatively sharp bend that causes the digging engagement of the elongated member with the insert edge. Therefore, the spacing of the bridge member 8 to the edge is not critical.

In the alternative, the sharpness of the bend may be increased further by eliminating the passages in the male housing segment 10. In this case, the elongated member 12 is bent about the insert edge 78 manually. The end regions of the elongated member are then passed through two apertures (not shown) in the housing front wall instead of slots such as slots 46. The male housing segment is then folded into the recess 52 and locked in place. The elongated member 12 in this instance abuts the insert on opposing insert broad surfaces resulting in an increased sharp bend. The male segment has a surface corresponding to the mesa 62 which also abuts the elongated member on a side of the elongated member opposite the insert in the recess 52. The male housing segment in this region may have a planar surface or may have a pair of spaced channels similar to channels 68 and 70 for receiving the elongated member 12. The male housing segment in this embodiment thus forms a spaced region with the insert serving as one or more passage portions for the elongated member.

The purpose of the sharp bend is to cause the edge 78 to dig into and cut the elongated member 12 in response to withdrawal pulling forces on the elongated member. When stranded steel wire is employed, the elongated member 12 is preferably 0.030–0.060 inches (0.76–1.52 mm) in diameter and the insert preferably 0.010 inches thick spring steel. A linear edge of this thickness serves to sever the wire without otherwise forming the edge into a cutting edge. It is the sharp bend which causes the digging and cutting action of the edge into the wire as the wire is pulled in the passages. It does not matter which end region is pulled, either end will be severed.

It will occur that the disclosed embodiment provides a seal that locks both ends of an elongated member to a single structure. If it is desired to lock the elongated member ends to separate structures then a seal may be provided with only a single U-shaped passage. This latter seal grips one end of the elongated member. A second such seal can be used to seal the other end region of the elongated member. In this case the seals would be enlarged relative to the hasp opening so they can not fit therethrough. This arrangement requires only one of the seals to be destroyed to open the hasp. Of course, a pair of seals each with a dual set of passages as described herein in connection with the embodiment of FIG. 1 could be used to separately seal an elongated member ends in similar fashion.

In a further embodiment, the opening 24 in the insert 22 could be provided in the body member 32 via a relatively thinner wall (not shown) in the body in place of an opening in the insert. An insert is provided adjacent to each passage leg as separate elements or a single element with a large central opening. In this embodiment, the seal locking action is not believed to be as secure as a tamperer may deform the opening in the plastic body wall to which the stud is locked.

The enclosing of the male body 60 within the recess 52 provides further security against tampering by precluding direct access to the locking stud from the housing 4 external regions.

FIGS. 11–13 illustrate a further embodiment of the present invention employing a metal insert element 80, FIG. 13. Element 80 is formed from sheet metal, for example spring steel. Element 80 has two square in transverse section tubular portions 82 and 84 in mirror image relation. The portions are connected by a bridge section 86. A V-shaped notch 88 may be formed on one side of each of the tubular portions. The material of element 80 is sufficiently thin so that section 86 is bendable manually.

In FIG. 11, a female thermoplastic molded housing segment 90 is somewhat similar to the housing segment 6 of the embodiment of FIG. 1. Segment 90 is formed with a pair of parallel adjacent passage leg portions 92 (only one being shown) each of which receives the tubular portion 84 of a corresponding element 80. The segment 90 has a pair of bores 94 (one being shown) which is reduced in transverse dimension than the passages of tubular element 80. Each bore 94 is in communication with the passages of the element 80 and with the housing segment 90 exterior at the housing segment front wall 91 for receiving an elongated element such as a wire 96 and the like. A pair of slots 93 are formed in the front wall 91 (only one being shown).

Not shown is a horizontal opening in the housing in wall 98 for receiving and engaging locking stud 100 on the male housing segment 102. This opening is similar to opening 24 in the insert 22, FIG. 6. A recess 104 is formed in the upper portion of the housing segment 90 for receiving the male housing segment 102 in similar fashion as the arrangement of the embodiment of FIG. 1.

Bridge member 106 may be identical to the bridge member 8 of FIG. 1 for hingedly connecting male housing segment 102 to female housing segment 90.

The male housing segment 102 has a pair of passage leg portions 108 (one being shown) aligned with the passage leg portions 92 in segment 90. A pair of bores 110 (one being shown) couple the leg portions 108 externally the housing segment 102.

In operation, the wire 96 is passed through the various passage leg portions as shown in FIG. 12 similar to the member 12 (FIG. 1) forming a loop 96' similar to the loop 12'. The male segment is folded over at the hinges of the bridge member 106. The male segment 102 and the bridge member are placed into the recess 104 in the female housing segment 90. This bends the tubular element 80 bridge section 86 as shown in FIG. 12. At the same time, the wire 96 is bent at the notches 88 of the tubular element 80 into a U-shape conforming with the U-shape of the passage leg portions 92 and 108 of each resulting U-shaped passage.

A relatively sharp 180° bend is generated in the wire at the notches 88. The wire 96, when withdrawn by pulling it axially through the element 80 passages in segments 82 and 84, causes the element 80 to dig into and sever the wire 96. The spacing between the passage portions in the male and female housing segments of FIG. 12 is exaggerated for illustration. In practice the spacing is relatively small to produce a relatively sharp 180° bend in the wire.

In the alternative, a pair of metal sheets (not shown) may be used in place of the tubular element 80 for performing the desired wire severing function. In the embodiment of FIGS. 11 and 12, however, the locking engagement of the stud 100 is plastic-to-plastic and, therefore, not as desirable as plastic-to-metal as in the embodiment of FIG. 1.

It will occur to one of ordinary skill that various modifications to the disclosed embodiments may be made without departing from the scope of the invention in the claims appended hereto. It is intended that the invention be defined by the appended claims and that the described embodiments are given by way of illustration and not limitation.

What is claimed is:

1. A seal for use with an elongated member comprising:

a housing comprising first and second segments and having a front end;

first and second U-shaped passages in the housing in communication with the front end, said passages for receiving the elongated member, said passages each having spaced leg portions, a leg portion being in each segment, each passage being adjacent to the front end and having a U-shaped bend portion within the housing distal said front end; and at least one separate element within the housing and having an edge, said edge being at said bend portion of each passage for locking engagement with opposite ends of the received elongated member, said bend portions providing a sufficiently sharp bend for cooperating with said edge for severing said elongated member in response to withdrawal of said elongated member from each said passage in a direction along the corresponding passage.

2. The seal of claim 1 wherein the housing segments include means such that the segments are rotatable relative to each other, said segments each forming a leg portion for each said passages and having a first position in which the leg portions of the respective first and second passages are positioned for receiving said elongated member and a second interlocked position in said engagement.

3. The seal of claim 2 further including a bridge segment intermediate and coupled to the first and second segments for forming said bend portions with the housing.

4. The seal of claim 3 wherein said first segment has a recess for receiving said second segment, said bridge segment being hinged to said first and second segments, said first and second segments including complementary locking means for locking said segments in the second interlocked position.

5. The seal of claim 3 wherein said U-shaped passages are in parallel side-by-side relation.

6. The seal of claim 1 wherein the element is sheet metal and has opposing broad surfaces contiguous with at least a portion of each said passages.

7. The seal of claim 6 wherein said element is secured to the first segment and having an aperture therein, the second segment having a male locking stud protruding therefrom for selective locking engagement with the aperture.

8. The seal of claim 7 including a bridge segment rotatably secured to said first and second segments for coupling the segments together and for enclosing said bend portions, each of the first and second segments having a passage leg portion therein in communication with a corresponding bend portion for receiving said elongated member, a leg portion of each passage being in the first segment and having a corresponding passage leg portion formed by the second segment.

9. The seal of claim 1 wherein said element comprises at least one tubular portion.

10. The seal of claim 3 wherein the housing is molded one piece thermoplastic and the bridge segment is connected to said first and second segments with respective living hinges.

11. The seal of claim 1 wherein said passages are in side-by-side parallel relation and at least partially contiguous with an element surface contiguous with said edge.

12. The seal of claim 1 including a bridge member hinged to the first and second segments, said segments having a first open position for receiving said elongated member wherein leg portions of each passage are axially aligned in the open position and are juxtaposed in a second locked folded position.

13. The seal of claim 1 wherein the housing has a wall at the front end with an edge, a plurality of openings in the wall, each opening corresponding to a passage, one of said openings comprising an aperture in said wall spaced from the edge and the other of said openings for each said passage comprises a slot in said wall in communication with said edge.

14. A seal comprising:

a female housing segment having front end and rear ends, the segment having a recess and a first passage leg in communication with the ambient at the front end and extending toward the rear end;

an element secured to the housing segment and having an edge distal the front end in communication with the first passage leg;

a male housing segment for engaging the female segment in said recess forming a housing, said male segment forming a second passage leg at least when engaged, the second leg being in communication with the element edge and with the ambient at the female segment front end, said passage legs forming a U-shaped passage for receiving an elongated member, said U-shaped passage forming a U-shaped bend about said edge, said bend being sufficiently sharp and cooperating with the element edge within the housing for severing said received member in response to withdrawal of the received member from said passage in a direction along the passage, the male and female housing segments including complementary locking means for locking the male segment to the female segment in the recess to form the housing and for locking the received member at said edge within the housing.

15. The seal of claim 14 further including the elongated member in said U-shaped passage engaged with said element edge wherein the elongated member is a wire.

16. The seal of claim 14 wherein the element is sheet metal secured to the female segment, at least one of said passages being at least partially contiguous with said element.

17. The seal of claim 14 wherein the recess and first passage leg are open to the ambient at the rear end, further including a bridge member hinged to the male and female segments, said segments and bridge member having a first unfolded position for receiving said elongated member at an associated passage leg, said segments and bridge member having a second locked folded position, said bridge member for enclosing the female segment rear end.

18. The seal of claim 14 in wherein said male and female housing segments have a pair of said U-shaped passages.

19. The seal of claim 14 wherein the second passage leg is formed in the male segment.

20. The seal of claim 14 wherein the second passage leg is between the male segment and the element.

21. The seal of claim 14 wherein the complementary locking means comprises an aperture in the metal element and a locking stud extending from the male segment for locking engagement with the aperture.

22. A seal comprising:

a first housing segment having a wall with an edge, said wall having two first spaced openings and two second spaced openings, said second openings each being in communication with the edge;

a bridge member hinged to an end of the housing segment distal said wall;

said first housing segment having a pair of first passages in communication with the first openings and said housing segment end;

a sheet material element having opposing sides, one side being adjacent to said passages and having an edge in communication with said housing segment end, said housing segment having a recess on a side of said element opposite said passages;

a second housing segment hinged to the bridge member and having a pair of second passages, all said passages being arranged for receiving an elongated flexible member; and locking means associated with the first and second segments for locking the second segment in the recess of the first segment and for forming a pair of U-shaped passages with the first and second passages, said U-shaped passages each comprising a first passage and a second passage wherein the bridge member encloses a relatively sharp bend in the U-shaped passage and said sheet element is at said bend, said bend being sufficiently sharp and cooperating with the edge for severing said elongated member in response to withdrawal of said elongated member from said passages in a direction along said passages.

23. A seal comprising:

a housing comprising first and second segments;

at least one passage in the housing in communication with the ambient external to and through a wall of the housing, said passage for receiving an elongated member, said passage having a leg portion in each segment, each leg portion being in communication with said ambient, and said passage including a U-shaped bend portion located within the housing distal said wall; and a separate element within the housing having an edge, said edge being at said bend portion for engaging said received elongated member and for locking the elongated member to the housing, said bend portion being sufficiently sharp and cooperating with the edge for severing said elongated member in response to axial withdrawal of said elongated member from said at least one passage in a direction along the at least one passage.

* * * * *